US005108516A

United States Patent [19]

Doudeau

[11] Patent Number: 5,108,516

[45] Date of Patent: Apr. 28, 1992

[54] AL-LI-CU-MG ALLOY WITH GOOD COLD DEFORMABILITY AND GOOD DAMAGE RESISTANCE

[75] Inventor: Michel Doudeau, Bordeaux, France

[73] Assignee: Cegedur Pechiney Rhenalu, Paris, France

[21] Appl. No.: 727,453

[22] Filed: Jul. 9, 1991

Related U.S. Application Data

[63] Continuation-in-part of Ser. No. 506,109, Apr. 9, 1990, abandoned.

[30] Foreign Application Priority Data

Apr. 21, 1989 [FR] France ..... 89 06135

[51] Int. Cl.[5] ..... C22F 1/04; C22C 21/12; B22D 21/00

[52] U.S. Cl. ..... 148/2; 148/11.5 A; 148/12.7 A; 148/159; 148/417; 148/439; 420/529; 420/532; 420/533; 420/534; 420/535

[58] Field of Search ..... 148/2, 11.5 A, 12.7 A, 148/159, 417, 418, 439; 420/532, 533, 534, 535, 529

[56] References Cited

U.S. PATENT DOCUMENTS 4,735,774 4/1988 Narayanan et al. ..... 420/533

*Primary Examiner*—R. Dean
*Assistant Examiner*—Robert R. Koehler
*Attorney, Agent, or Firm*—Dennison, Meserole, Pollack & Scheiner

[57] ABSTRACT

The invention concerns an alloy based on Al and essentially containing Li, Cu, Mg and Zr as its chief elements. It has good cold deformation capability, particularly when sheets or strips are being cold rolled, and good damage resistance, that is to say essentially good resistance to fatigue and corrosion under tension, and good fracture toughness. The alloy is of the following composition, by weight: from 1.7 to 2.25% Li; from 1.0 to 1.5% Cu; from 1.0 to 1.8% Mg; from 0.04 to 0.15% Zr; up to 2% Zn; up to 0.15% Fe; up to 0.15% Si; up to 0.5% Mn; up to 0.25% Cr; others: each ≦0.05%, total ≦0.15%; remainder Al. The alloy can be used as a structural element, particularly in the aircraft and space industries.

25 Claims, 4 Drawing Sheets

AL-LI-CU-MG ALLOY WITH GOOD COLD DEFORMABILITY AND GOOD DAMAGE RESISTANCE

The present application is a continuation-in-part of U.S. Patent application Ser. No. 07/506,109, filed Apr. 9, 1990, now abandoned.

The invention concerns an alloy based on Al and essentially containing Li, Cu, Mg and Zr as its chief elements. It has good cold deformation capability, particularly when sheets or strips are being cold rolled, and good damage resistance, that is to say essentially good resistance to fatigue and corrosion under tension, and good tenacity.

Al alloys containing Li are essentially used for applications which require a high modulus of elasticity and low density, associated with high mechanical strength. The search for high mechanical strength leads to the definition of alloys with a higher and higher content of the main elements Li, Mg and Cu. Commercial alloys 8090, 8091, 2090 and 2091, as designated by the Aluminum Association, are known in this field.

However, the high strength is often associated with relatively low ductility or tenacity and particularly with very limited cold deformation capability, particularly during cold rolling. This is manifested essentially by the formation of large mill edge cracks when sheets or strips are cold rolled.

The invention therefore aims to find an alloy of this family which behaves well during cold working, while maintaining good mechanical properties of tensile strength, fatigue resistance, resistance to corrosion under tension and fracture toughness.

More specifically, the invention seeks to obtain an alloy which, in the state in which it is used, has mechanical properties (R 0.2; Rm; A %) equivalent to those of alloy 2024-T3 (e.g. for sheets 2 to 10 mm thick, R 0.2≧290 MPa in all directions in the rolling plane, in accordance with standard AIR 9048), good fracture toughness (e.g. for sheets thinner than 6 mm, Kc T-L≧125 Mpa $\sqrt{m}$ measured in accordance with standard AMS 4100), and good resistance to stress corrosion cracking (e.g. for products over 25 mm thick, a tensile stress with no breakage for 30 days of over 200 MPa in the short transverse direction, under the test conditions described in standards ASTM G44, G47 and G49).

The objects are achieved with an alloy of the following composition (% by weight):

| | | |
|---|---|---|
| | 1.7 ≦ Li ≦ 2.25 | |
| | 1.0 ≦ Cu ≦ 1.5 | |
| | 1.0 ≦ Mg ≦ 1.8 | |
| with | Mg/Cu < 1.5 | |
| | 0.04 ≦ Zr ≦ 0.15 | |
| | Zn up to 2 | |
| | Fe up to 0.15 | |
| | Si up to 0.15 | |
| | Mn up to 0.5 | |
| | Cr up to 0.25 | |
| | others: | each ≦ 0.05 |
| | | total ≦ 0.15 |
| | remainder: | Al. |

The alloy preferably has an Li content <2.20%, an Mg content >1.1% and/or an Mg/Cu ratio <1.4. When the alloy contains Zn, the content of it is preferably from 0.1 to 0.4%.

Mechanical strength properties are inadequate below the lower limits for the main alloy elements; mill edge cracks become too large beyond Li=2.3%; damage tolerance properties, and particularly durability in fatigue, decrease beyond Cu=1.5% or Mg=1.8%; corrosion resistance decreases if Mg/Cu ≧1.5. Zn contributes to the mechanical strength, and resistance to corrosion under tension is improved if 0.1≦Zn≦0.4%.

The alloy according to the invention is produced and worked in the conventional manner; a sequence of operations comprising homogenisation, hot working such as rolling, forging, extrusion, swaging, etc., possibly followed by annealing and/or cold working such as rolling, stretch forming, drawing, sizing, etc., is appropriate. Homogenisation is generally carried out at from 450° to 550° C. for 12 to 48 hours, and preferably at a temperature below 525° C. Any annealing is carried out at from 350° to 475° C. for 1 to 20 hours.

The final heat treatment comprises solution anneal at from 450° to 550° C. and preferably at a temperature below 525° C., hardening and an ageing from 135° to 200° C. and preferably 150° to 200° C., for times ranging from 1 hour to 100 hours, the longest times generally being associated with the lowest temperatures and vice versa. 1 to 5% plastic deformation (by tension or compression) may be applied between hardening and ageing.

The invention will be understood better from the following examples, which are illustrated in the accompanying drawings. In these:

EXAMPLE 1

Mechanical Properties of Tension and Stress Corrosion Resistance

A casting of the following chemical composition (weight %):

Li 1.95; Cu 1.25; Mg 1.1; Zr 0.07; Fe 0.04: Si 0.04; remainder Al is homogenised at 525°-530° C. for 25 hours, reheated to 475° C. for 24 hours, hot rolled from 262-3.62 mm thickness, annealed at 450° C. for 1 hour into coil form, then cold rolled to 1.6 mm thickness. solution annealed at 500° C.+10° C. for 15 minutes and 2% stretched, then the aged under the following conditions: A/ 96 hours at 135° C. B/48 hours at 175° C. and C/19 hours at 195° C.

The results for the mechanical tension properties determined under the conditions laid down in standard ASTM E8M on flat specimens (Kt=1.035) in the longitudinal direction (L), the transverse direction (T) and at 60° to the rolling direction (X), and the results of tests of stress corrosion cracking in the long transverse direction (TL) under the conditions mentioned, are given in Table I.

EXAMPLE 2

Cold Rolling Capability

Castings with variable Li, Cu and Mg contents, the analyses for which are given in Table II, are melted cast into a plate 800×300 mm² in section, then homogenised, scalped, reheated and hot rolled to a thickness of 4 mm. They are then cold rolled and characterised by the maximum length of the mill edge cracks produced, for each intermediate cold working conditions.

Figure 1:
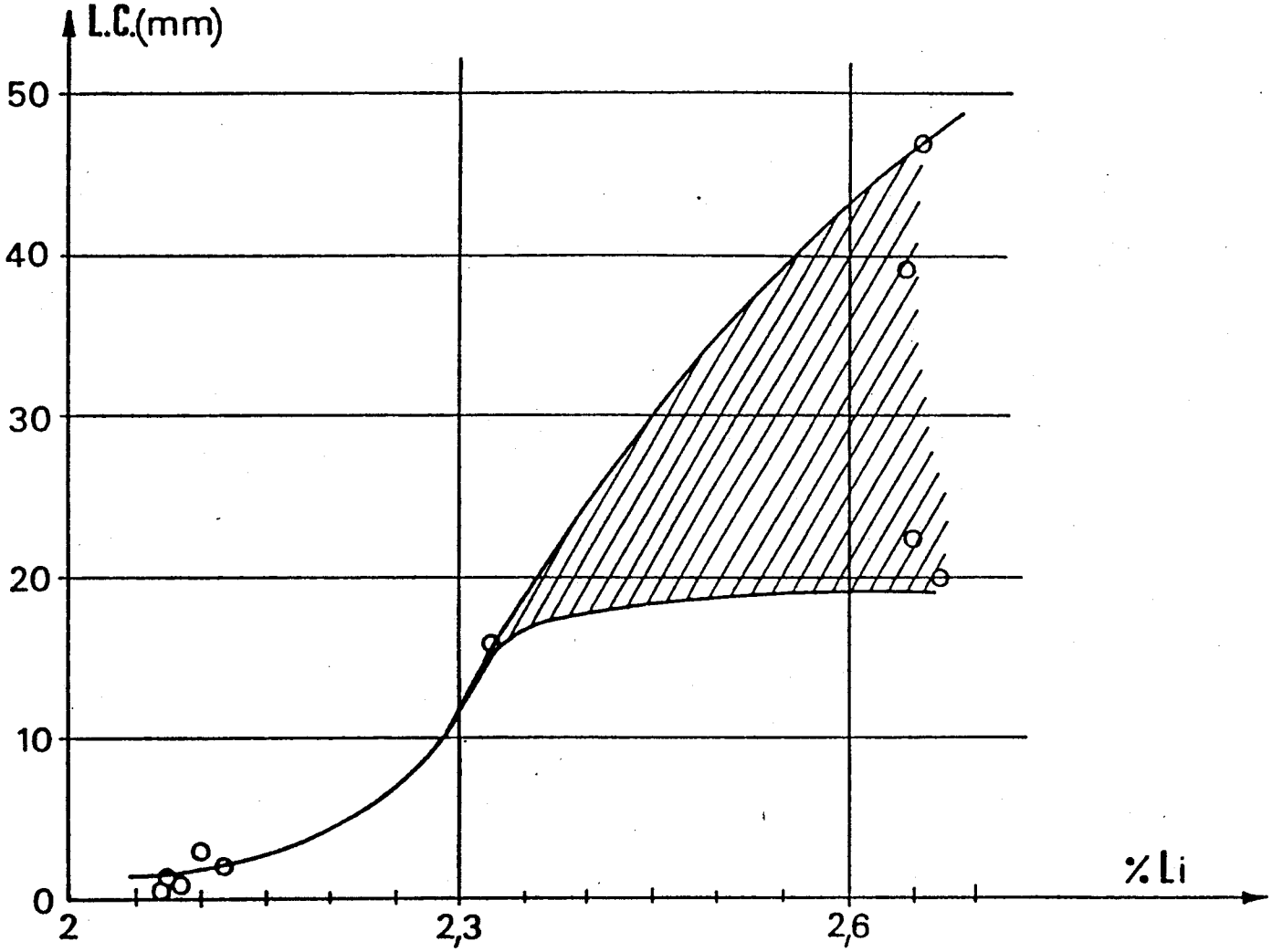
FIG. 1 shows the variation in the (maximum) length of the mill edge cracks during cold rolling, as a function of the Li content (with approximately 70% cold working).

FIG. 1 shows that, beyond Li=2.3% and with 70% cold working the mill edge cracks become large and in particular unstable, that is to say, they can spread rapidly to the extent of detaching a piece of the rolled sheet.

EXAMPLE 3

Fracture Toughness

Sheets 1.6 mm thick, which are recrystallised and obtained from the above castings, are treated by ageing after solution anneal at 527° C. for 20 minutes, then 2% stretching. The aging is made either at 190° C. for 12 hours (•) or at 150° C. for 24 hours (+).

Figure 2:
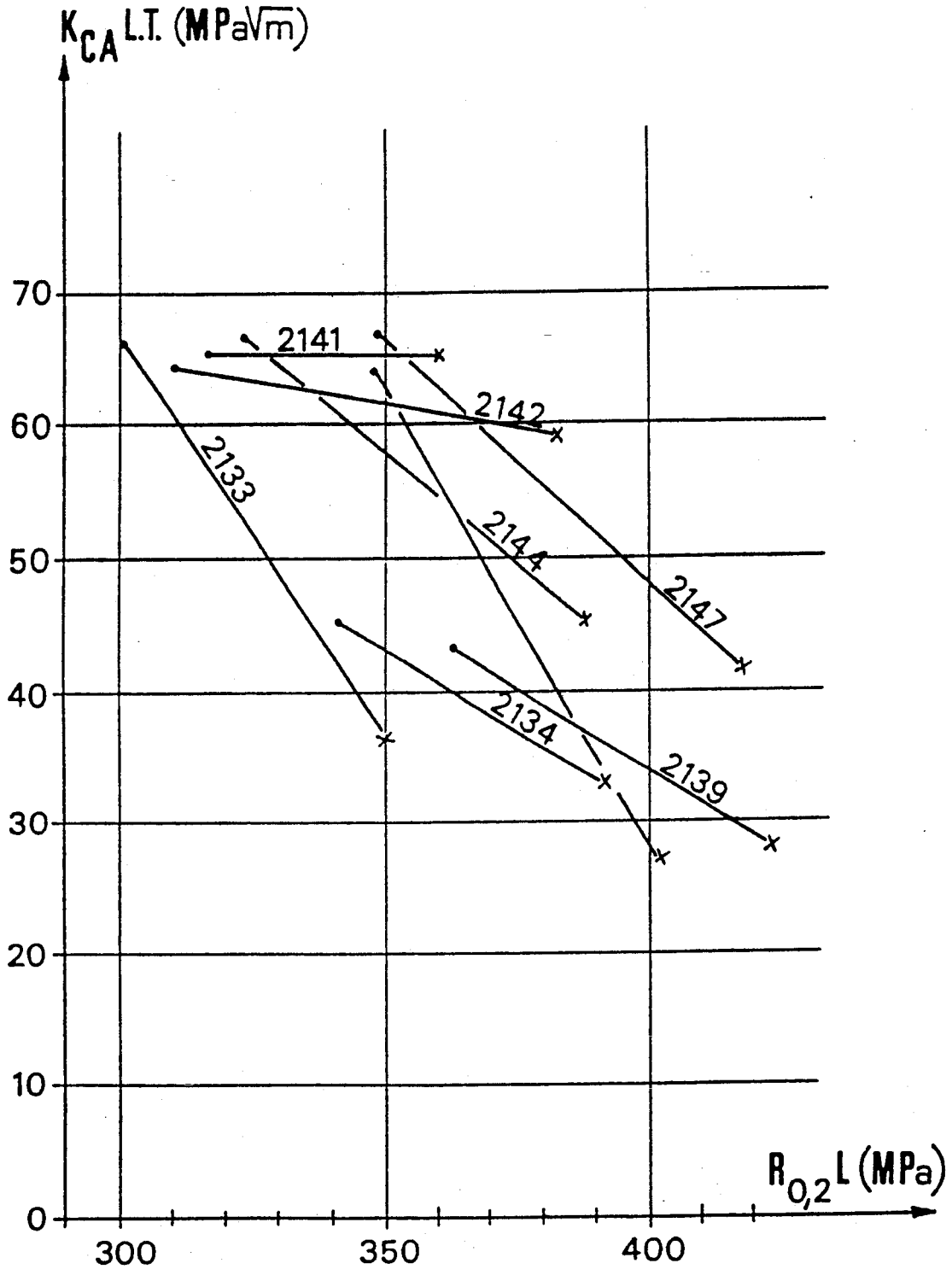
FIG. 2 shows the fracture toughness of various castings as a function of their longitudinal elastc limit.

The KcA values in accordance with internal standard MBB-FOKKER FH 4.2,1400, determined by tension to rupture of specimens 620 mm long, 160 mm wide and with a 53.3 mm central notch in the L-T direction, are given in FIG. 2 as a function of the yield strength in the longitudinal direction. The casting according to the invention has the best overall tenacity.

EXAMPLE 4

Speed at Which Cracks Spread in Fatigue

Figure 3B:
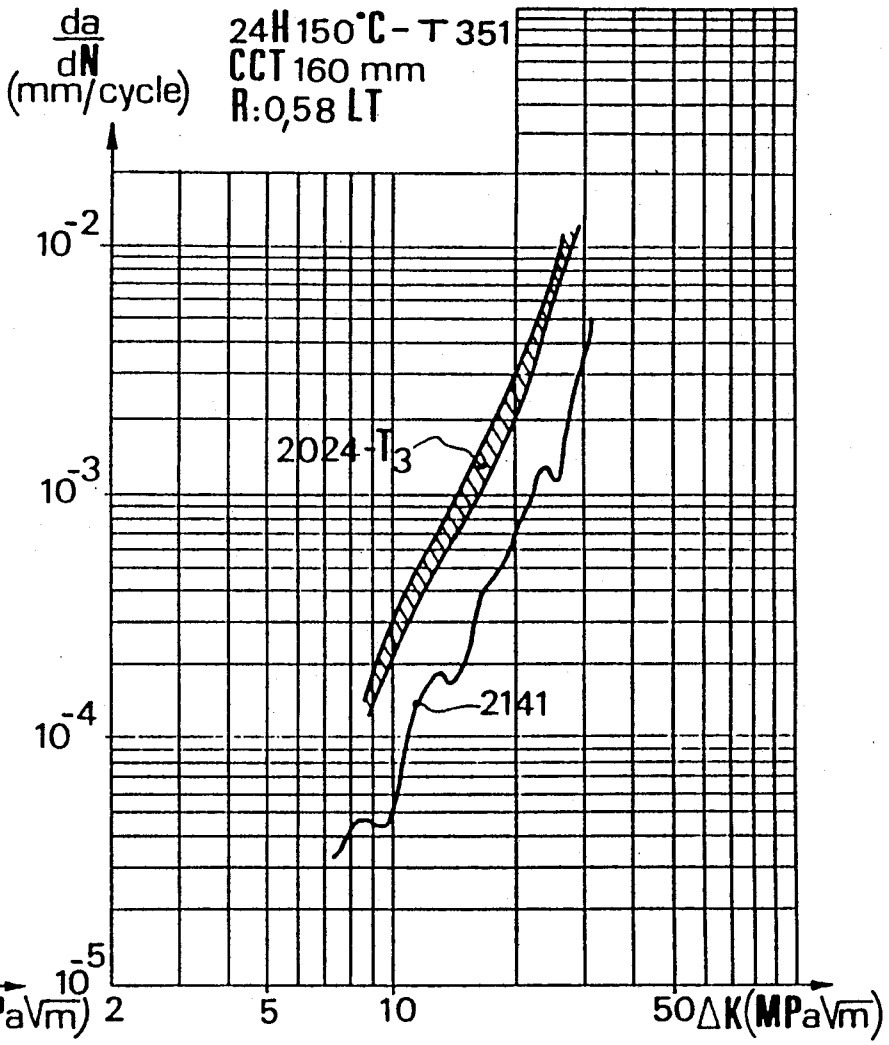
FIGS. 3A and 3B show the cracking speed as a function of ΔK, of a casting according to the invention, compared with that of 2024-T3.
Figure 3A:
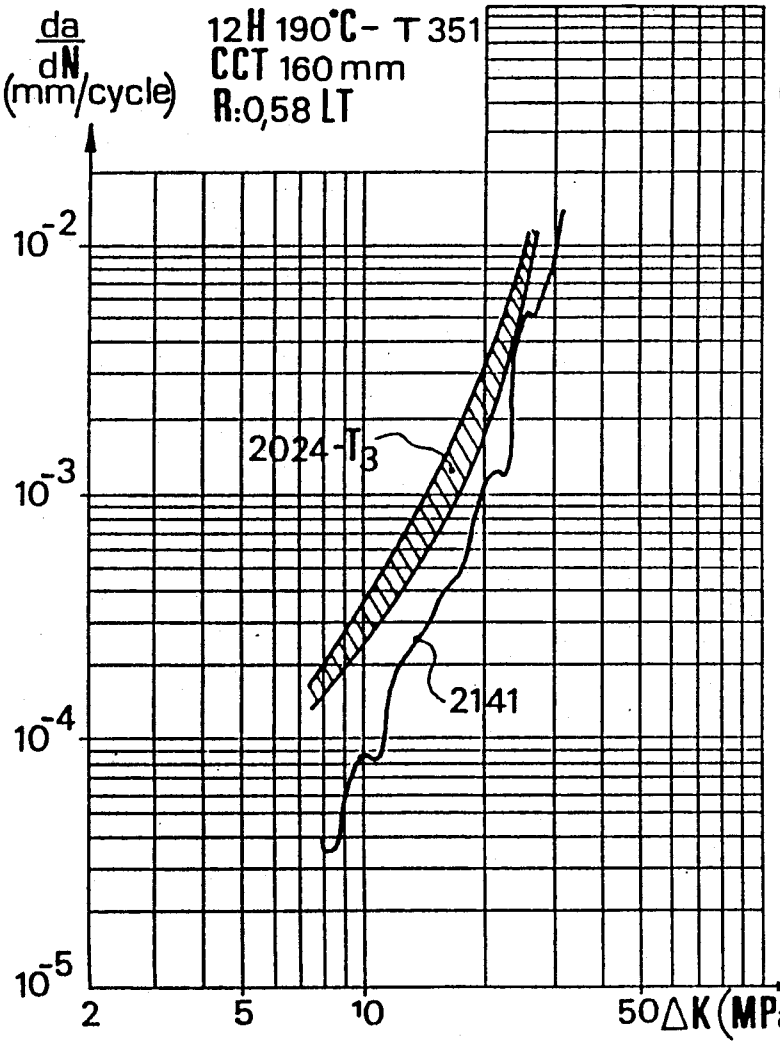

The properties of sheets obtained from the above casting thickness 1.6 mm, are compared with those of conventional alloy 2024 in state T3, in the heat treatment states given in Example 3 on specimen CCT 160 mm (internal standard MBB-FOKKER, direction LT) and shown in FIGS. 3A and 3B. The casting has greater fatigue resistance than alloy 2024-T3.

EXAMPLE 5

Fatigue: Initiation of Cracks

Figure 4:
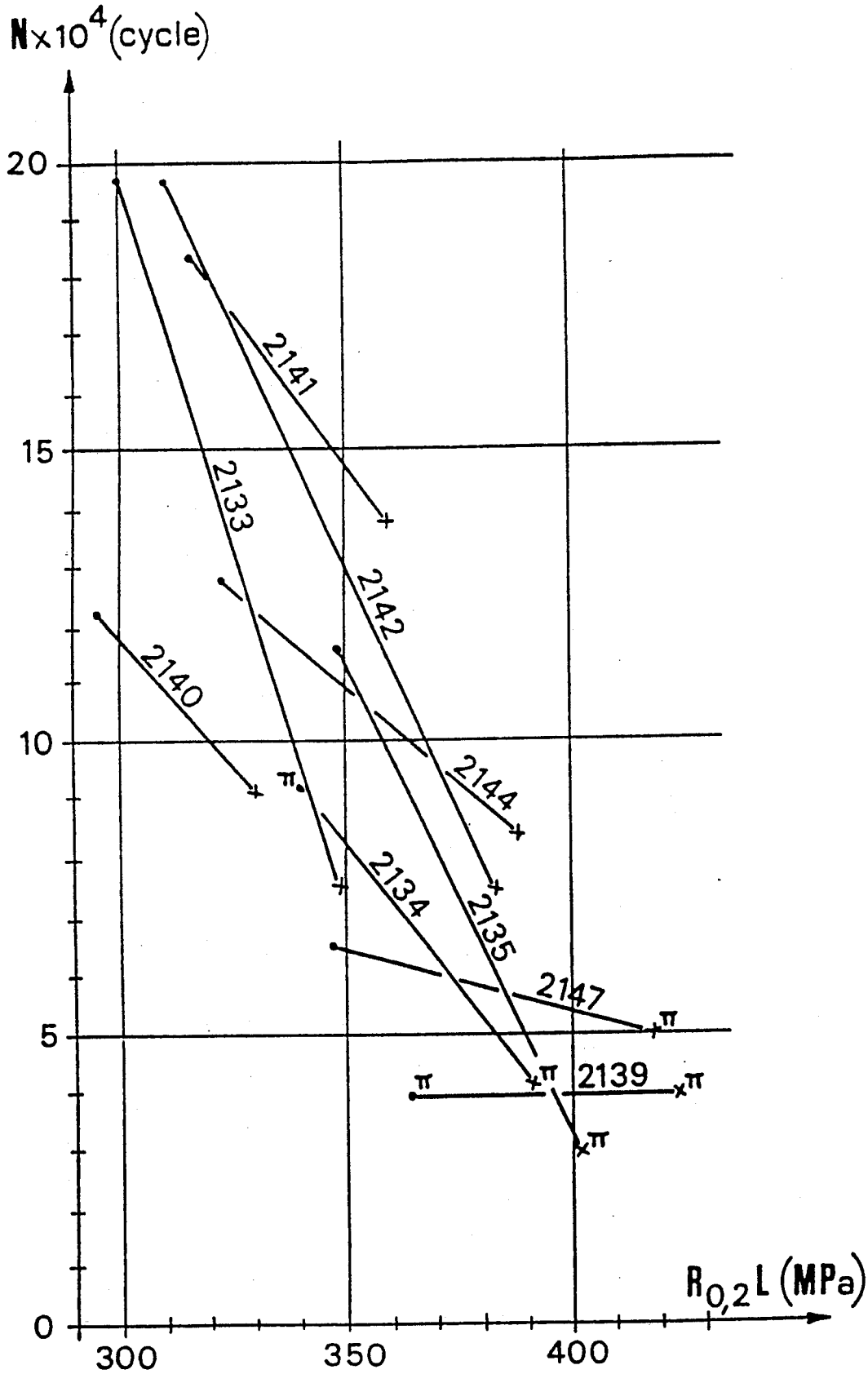
FIG. 4 shows the durability of specimens of fatigue in the castings studied, as a function of their longitudinal yield stress.

The fatigue properties of sheets 1.6 mm thick, obtained from the above castings, are determined in undulating tension ($\sigma=90\pm40$ MPa) in the direction L-T on prismatic specimens (Kt=1) in the casting treatment states corresponding to Example 3. The casting according to the invention has the best fatigue properties (see FIG. 4).

TABLE I

| AGING | DIRECTION | R 0,2 (MPa) | Rm (MPa) | A % (%) | CSC TL (days) |
|---|---|---|---|---|---|
| | L | 338 | 435 | 12.2 | — |
| 96 hours at 135° C. | TL | 343 | 451 | 14.2 | 3 NR 30* |
| | X | 290 | 414 | 17.2 | — |
| | L | 382 | 440 | 11.0 | — |
| 46 hours at 175° C. | TL | 390 | 456 | 11.5 | 3 NR 30* |
| | X | 336 | 419 | 13.5 | — |
| | L | 365 | 416 | 11.0 | — |
| 19 hours at 195° C. | TL | 372 | 430 | 11.5 | 3 NR 30* |
| | X | 341 | 400 | 13.0 | — |

*3 specimens not broken in 30 days

TABLE II

CHEMICAL CONTENT OF CASTINGS STUDIED (weight %)

| N* | % Li | % Cu | % Mg | |
|---|---|---|---|---|
| 2133 | 2,67 | 1,12 | 0,63 | H.I.* |
| 2134 | 2,66 | 1,09 | 1,28 | " |
| 2135 | 2,65 | 1,64 | 0,69 | " |
| 2139 | 2,64 | 1,65 | 1,22 | " |
| 2140 | 2,07 | 1,17 | 0,69 | " |
| 2141 | 2,06 | 1,14 | 1,45 | Inv** |
| 2142 | 2,07 | 1,65 | 0,68 | H.I. |
| 2147 | 2,12 | 1,74 | 1,44 | " |
| 2149 | 2,35 | 1,48 | 0,98 | " |
| 2144 | 2,1 | 1,9 | 0,92 | " |

Fe = 0.03%; Si = 0.02% and Zr = 0.05% for all the heats
*H.I.: not according to the invention
**Inv: according to the invention

What is claimed is:

1. An Al alloy with good cold deformability and good properties of damage resistance in the treated state, consisting essentially of, by weight:

| | | |
|---|---|---|
| | from 1.7 to 2.25% Li | |
| | from 1.0 to 1.5% Cu | with Mg/Cu < 1.5 |
| | from 1.0 to 1.8% Mg | |
| | from 0.04 to 0.15% Zr | |
| | up to 2% Zn | |
| | up to 0.15% Fe | |
| | up to 0.15% Si | |
| | up to 0.5% Mn | |
| | up to 0.25% Cr | |
| Others: | each ≧ 0.05% | |
| | total ≧ 0.15% | |
| remainder: | Al. | |

2. The alloy of claim 1, containing over 1.1% Mg.

3. The alloy of claim 1, wherein Mg/Cu is <1.4.

4. The alloy of any of claims 1 to 3, containing 0.1 to 0.4% Zn.

5. A method of obtaining the alloy of any of claims 1 to 3, comprising the sequential steps of: melting, casting, homogenizing, hot working, optionally annealing and cold working and ageing, wherein homogenizing takes place at from 450° to 550° C. for 12 to 48 hours.

6. The method of claim 5, wherein homogenizing takes place at from 450° to 525° C.

7. The method of claim 5, wherein annealing is carried out at from 350° to 475° C. from 1 to 20 hours.

8. The method of claim 5, wherein solution annealing is carried out at from 450° to 550° C.

9. The method of claim 7, wherein solution annealing is carried out at from about 450° to 525° C.

10. The method of claim 5, wherein the ageing is at from 135° to 200° C.

11. The method of claim 10, wherein the ageing is at from 150° to 200° C.

12. The alloy of claim 2, wherein the Mg/Cu is <1.4.

13. A method of obtaining the alloy of claim 4, comprising the sequential steps of: melting, casting homogenizing, hot working, optionally annealing and cold working, solution annealing, quenching, optionally cold working and ageing, wherein homogenization takes place at from 450° to 550° C. for 12 to 48 hours.

14. The method of claim 13, wherein homogenizing takes place at from 450° to 525° C.

15. The method of claim 13, wherein annealing is carried out at from 350° to 475° C. from 1 to 20 hours.

16. The method of claim 13, wherein solution annealing is carried out at from 450° to 550° C.

17. The method of claim 13, wherein solution annealing is carried out at from 450° to 525° C.

18. The method of claim 13, wherein the ageing is at from 135° to 200° C.

19. The method of claim 18, wherein the ageing is at from 150° to 200° C.

20. The method of claim 6, wherein the ageing is at from 135° to 200° C.

21. The method of claim 7, wherein the ageing is at from 135° to 200° C.

22. The method of claim 8, wherein the ageing is at from 135° to 200° C.

23. The method of claim 9, wherein the ageing is at from 135° to 200° C.

24. The method of claim 13, wherein the ageing is at from 150° to 200° C.

25. The alloy of claim 1, containing less than about 2.2% Li.

* * * * *